US006536085B1

(12) United States Patent
Milano

(10) Patent No.: US 6,536,085 B1
(45) Date of Patent: Mar. 25, 2003

(54) ADJUSTABLE FASTENER FOR CLOTHING, ESPECIALLY BRASSIERES

(75) Inventor: Terri M. Milano, Blue Point, NY (US)

(73) Assignee: Multiple Adjustable Closure Corp.

( * ) Notice: Subject to any disclaimer, the term of this patent is extended or adjusted under 35 U.S.C. 154(b) by 0 days.

(21) Appl. No.: 09/545,482

(22) Filed: Apr. 7, 2000

(51) Int. Cl.[7] ..... A41F 1/00
(52) U.S. Cl. ..... 24/580.11; 24/580.1
(58) Field of Search ..... 24/3.11, 399, 400, 24/579.1, 580, 581, 586, 666, 667, 668, 701, DIG. 16; 224/197; 450/82–84, 58; 2/73, 310, 311

(56) References Cited

U.S. PATENT DOCUMENTS

| | | | | |
|---|---|---|---|---|
| 886,894 | A | 5/1908 | Fowler | 2/237 |
| 1,305,073 | A | 5/1919 | Decker | 2/323 |
| 1,412,033 | A | 4/1922 | Able | 2/323 |
| 1,709,181 | A | 4/1929 | Matlock | 24/586 |
| 1,854,125 | A | 4/1932 | Faber | 24/580 |
| 2,040,046 | A | 5/1936 | Groesbeck | 2/310 |
| 2,423,046 | A | 6/1947 | Patterson | 450/86 |
| 2,653,323 | A | 9/1953 | Ganim | 450/82 |
| 2,657,392 | A | 11/1953 | Jackson | 2/323 |
| 2,753,569 | A | 7/1956 | Schmalz | 2/323 |
| 3,046,991 | A | 7/1962 | Andersen | 450/86 |
| 3,484,907 | A | 12/1969 | Elsenheimer | 24/579.1 |
| 6,253,428 | B1 | 7/2001 | Wang | 24/701 |
| 6,309,489 | B1 | 10/2001 | Fildan et al. | 156/73.3 |
| 6,321,419 | B1 | 11/2001 | Fildan et al. | 24/114.6 |

FOREIGN PATENT DOCUMENTS

| | | |
|---|---|---|
| DE | 2606576 | 8/1977 |
| EP | 0084747 | 8/1983 |

*Primary Examiner*—Robert J. Sandy
*Assistant Examiner*—Ruth C. Rodriguez
(74) *Attorney, Agent, or Firm*—Galgano & Burke

(57) ABSTRACT

An adjustable fastener includes a male part and a female part, both of which are made of soft pliable, sewable plastic. The female fastener part has three spaced apart openings. Each opening has a broad portion and a narrow portion. The male fastener part has a base with an upstanding riser with a flange at the end of the riser. The flange is dimensioned to fit into the broad portion of each opening in the female fastener part and the riser is dimensioned to fit snugly into the narrow portion of each opening in the female fastener part. The narrow portion of each opening in the female fastener part is rectilinear in shape and the riser is also rectilinear in section. Thus, when the riser is in the narrow portion of an opening in the female fastener part, rotation of the male fastener part relative to the female fastener part is prevented. The back side of the male fastener part is provided with parallel grooves which enhance gripping when releasing the fastener. Both of the fastener parts have a pair of parallel flanges at one end between which a back end is inserted and secured to the fastener part. The fastener parts are preferably attached to the garment back so that the openings in the female fastener part face the back of the wearer and the riser and flange on the male fastener part face away from the back of the wearer. The back of the female fastener part is preferable covered with fabric and/or bears a trademark or a design.

26 Claims, 4 Drawing Sheets

ADJUSTABLE FASTENER FOR CLOTHING, ESPECIALLY BRASSIERES

BACKGROUND OF THE INVENTION

1. Field of the Invention

The invention relates to fasteners for clothing. More particularly, the invention relates to an adjustable fastener for a brassier or similar garment.

2. State of the Art

Many articles of clothing are provided with adjustable fasteners. In particular, brassieres are typically provided with an adjustable fastener for connecting right and left center backs of the garment. These fasteners usually include one or more hooks and multiple eyelets spaced apart from each other so that the snugness of the garment eye can be adjusted by mating the hook(s) with the appropriate eyelet (s).

The known brassier fasteners have several disadvantages. First, being located at the back of the garment, they are difficult to manipulate. Second, the hooks and eyelets are typically made of metal and feel uncomfortable pressing against the back of the wearer. Third, the hook is typically free to rotate in the eyelet and allow the bra back to hike up into an uncomfortable configuration. Fourth, the fastener is typically thicker than the eyes to which it is attached and is visible through outerwear as a bump.

Many attempts have been made to provide a brassier fastener which is easy to operate, comfortable to the wearer and less visible. While these fasteners may solve some of the problems described above, they typically do not solve all of the problems and often introduce new problems. For example, in attempting to overcome the problems described above, many brassier fasteners sacrifice stability for comfort. This permits the fastener from accidentally detaching. Also, some fasteners which attempt to solve the problem of visibility have actually increased the difficulty in operation of the fastener.

SUMMARY OF THE INVENTION

It is therefore an object of the invention to provide an adjustable fastener for clothing, in particular brassieres.

It is also an object of the invention to provide an adjustable fastener which is easy to operate.

It is another object of the invention to provide an adjustable fastener which is soft and comfortable.

It is still another object of the invention to provide an adjustable fastener which is stable when fastened.

It is yet another object of the invention to provide an adjustable fastener which is concealed when fastened.

In accord with these objects which will be discussed in detail below, the adjustable fastener of the present invention includes a male part and a female part, both of which are made of soft pliable, sewable plastic. The female fastener part has three spaced apart openings. Each opening has a broad portion and a narrow portion. The male fastener part has a base with an upstanding riser with a flange at the end of the riser. The flange is dimensioned to fit into the broad portion of each opening in the female fastener part and the riser is dimensioned to fit snugly into the narrow portion of each opening in the female fastener part. The narrow portion of each opening in the female fastener part is rectilinear in shape and the riser is also rectilinear in section. Thus, when the riser is in the narrow portion of an opening in the female fastener part, rotation of the male fastener part relative to the female fastener part is prevented. The back side of the male fastener part is provided with parallel grooves which enhance gripping when releasing the fastener. Both of the fastener parts have a pair of parallel flanges at one end between which the garment back end is inserted and secured to the fastener part. The fastener parts are preferably attached to the garment's center backs so that the openings in the female fastener part face the back of the wearer and the riser and flange on the male fastener part face away from the back of the wearer. The back of the female fastener part is preferable covered with fabric and/or bears a trademark or a design.

According to one embodiment of the invention, the flange on the male fastener part is substantially circular and has a centrally located nub rising from its surface. The broad portion of each opening in the female fastener part is substantially circular and the narrow portion of each opening in the female fastener part has a nub-receiving well. This structure adds stability to the fastener, preventing accidental unfastening.

According to another embodiment of the invention, the flange on the male fastener part is substantially elliptical. The broad portion of each opening in the female fastener part is substantially elliptical and a pair of ears extend between the broad portion and the narrow portion of each opening in the female fastener part. This structure also adds stability to the fastener, preventing accidental unfastening.

According to one method of manufacture, both parts are injection molded and are fastened to brassier center backs by sewing. According to another method of manufacture, the male fastener part is injection molded, but the female fastener part is made from a laminate structure which includes two outer layers and two inner layers. The outer layers are made of a soft fabric material and the inner layers are made of soft plastic. One of the plastic layers has the openings as described and the other plastic layer has thick portions which surround the openings in the other plastic layer to create a space for receiving the male fastener part. According to a presently preferred embodiment, the plastic spacer is made by embossing a plastic sheet and the outer fabric layers are made from a single layer which is folded. All of the parts preferably have rounded edges and corners to prevent poking, snagging, and skin irritation.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
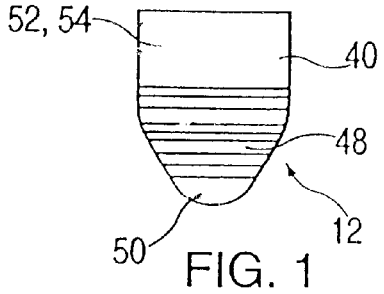
FIG. 1 is a plan view of the non-engaging side of a male fastener part according to a first embodiment of the invention.
Figure 2:
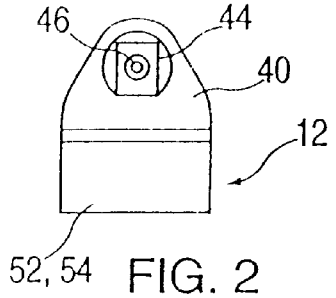
FIG. 2 is a plan view of the engaging side of the male fastener of FIG. 1.
Figure 3:
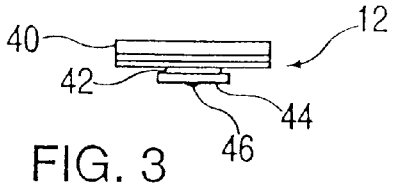
FIG. 3 is an end elevation view of the male fastener of FIGS. 1 and 2.
Figure 4:
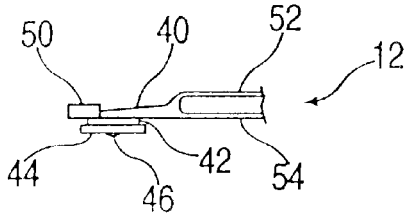
FIG. 4 is a side elevation view of the male fastener of FIGS. 1–3.
Figure 5:
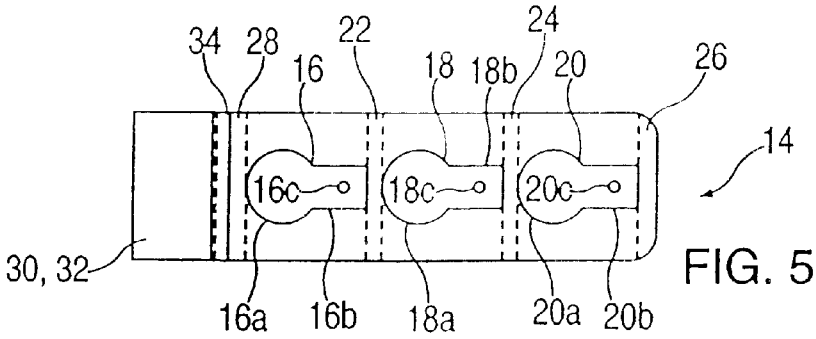
FIG. 5 is a plan view of the engaging side of a female fastener part according to the first embodiment of the invention.
Figure 6:
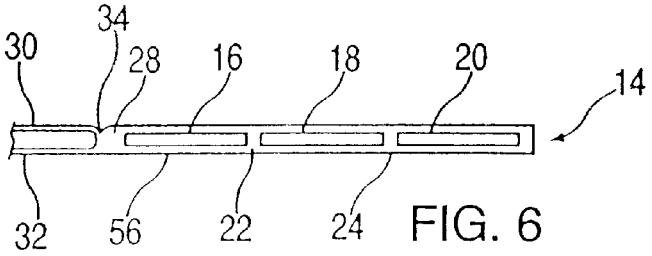
FIG. 6 is a side elevation view of the female fastener part of FIG. 5.

Referring now to FIGS. 1 through 7, an adjustable fastener 10 of the present invention includes a male part 12 and a female part 14, both of which are made of soft pliable, sewable plastic. As seen best in FIG. 5, the female fastener part 14 has three spaced apart openings 16, 18, 20. Each opening 16, 18, 20 has a broad portion 16*a*, 18*a*, 20*a* and a narrow portion 16*b*, 18*b*, 20*b*. Opening 16 is separated from opening 18 by a flexible rib 22 and opening 20 is separated from opening 18 by a flexible rib 24. The narrow portion 20*b* of opening 20 terminates at rib 26 and the broad portion 16*a* of opening 16 terminates at rib 28. A pair of parallel flanges 30, 32 extend from the rib 28 as seen best i n FIG. 6. At least one of the flanges 30, 32 has a live hinge 34. According to this embodiment, the broad portion 16*a*, 18*a*, 20*a* of each opening 16, 18, 20 is substantially circular. The narrow portion 16*b*, 18*b*, 20*b* of each opening 16, 18, 20 is substantially rectilinear and the narrow portion of each opening has a nub-receiving well 16*c*, 18*c*, 20*c*.

Referring now to FIGS. 1–4, the male fastener part has a base 40 with an upstanding riser 42 with a flange 44 at the end of the riser 42. The flange 42 is substantially circular and is dimensioned to fit into the broad portion of each opening in the female fastener part and the riser 42 is substantially rectilinear in section, as seen best in phantom line in FIG. 2, and is dimensioned to fit snugly into the narrow portion of each opening in the female fastener part. The flange 44 is provided with a centrally located nub 46 rising from its surface. The back side of the male fastener part 12 is provided with parallel grooves 48 and a finger stop 50 which enhance gripping when releasing the fastener. The male fastener part 12 is also provided with a pair of parallel flanges 52, 54, seen best in FIG. 4.

The fastener parts 12, 14 are attached to garment center backs (not shown) by inserting ends of the center backs between the flanges 30, 32, 52, 54, and stitching the center backs to the flanges. Preferably, the fastener is attached to the garment back so that the openings in the female fastener part face the back of the wearer and the riser and flange on the male fastener part face away from the back of the wearer. The back non-engaging surface 56 of the female fastener part 14 is preferable covered with fabric and/or bears a trademark or a design.

Figure 7:
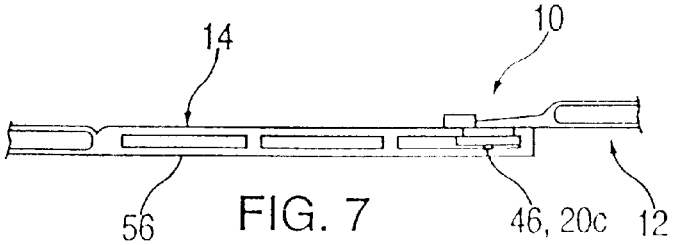
FIG. 7 is a transparent side elevation view of the male and female fastener parts engaged.
Figure 8:
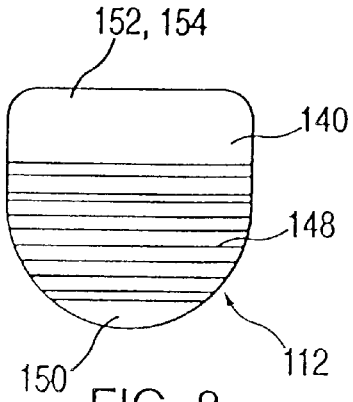
FIG. 8 is a plan view of the non-engaging side of a male fastener part according to a second embodiment of the invention.
Figure 9:
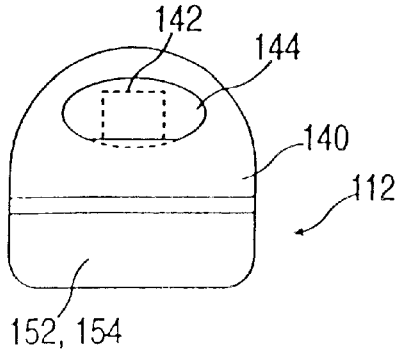
FIG. 9 is a plan view of the engaging side of the male fastener of FIG. 8.
Figure 10:
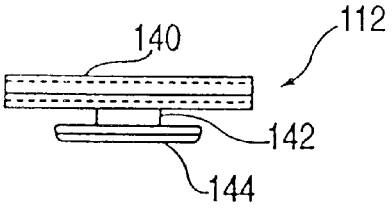
FIG. 10 is an end elevation view of the male fastener of FIGS. 8 and 9.
Figure 11:
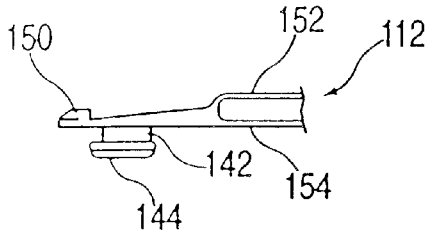
FIG. 11 is a side elevation view of the male fastener of FIGS. 8–10.
Figure 12:
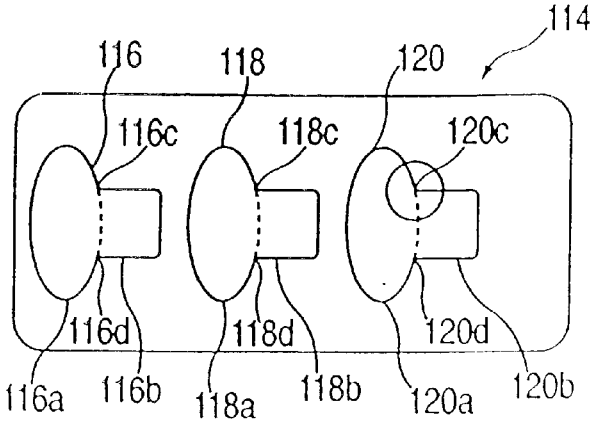
FIG. 12 is a plan view of the engaging side of a female fastener part according to the second embodiment of the invention.
Figure 13:
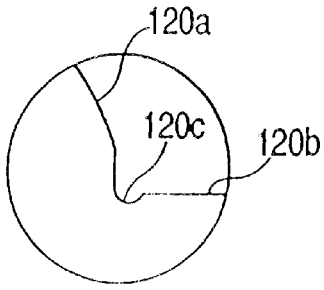
FIG. 13 is an enlarged view of the circled portion of FIG. 12.

As shown in FIG. 7, when the male and female fastener parts are engaged, the nub 46 resides in the nub receiving well 20*c* (or 16*c* or 18*c*) impeding lateral movement of the male part. The rectilinear riser 44 resides in the rectilinear narrow portion 20*b* (or 16*b* or 18*b*) preventing rotation of the parts relative to each other. The flange 44 prevents the male part from exiting the narrow portion orthogonally. According to this embodiment of the invention, both of the fastener parts are unitary members made by injection molding.

Turning now to FIGS. 8–13, a second embodiment of a fastener according to the invention is similar the first embodiment with similar reference numerals (increased by 100) referring to similar parts.

The fastener includes a male part 112 and a female part 114, both of which are made of soft pliable, sewable plastic. As seen best in FIG. 12, the female fastener part 114 has three spaced apart openings 116, 118, 120. Each opening 116, 118, 120 has a broad portion 116*a*, 118*a*, 120*a* and a narrow portion 116*b*, 118*b*, 120*b*. According to this embodiment, the broad portion 116*a*, 118*a*, 120*a* of each opening 116, 118, 120 is substantially elliptical. The narrow portion 116*b*, 118*b*, 120*b* of each opening 116, 118, 120 is substantially rectilinear and a pair of ears 116*c*, 116*d*, 118*c*, 118*d*, 120*c*, 120*d* extend between the broad and narrow portions.

Referring now to FIGS. 8–11, the male fastener part 112 has a base 140 with an upstanding riser 142 with a flange 144 at the end of the riser 142. The flange 142 is substantially elliptical and is dimensioned to fit into the broad portion of each opening in the female fastener part and the riser 142 is substantially rectilinear in section, as seen best in phantom line in FIG. 9, and is dimensioned to fit snugly into the narrow portion of each opening in the female fastener part. The back side of the male fastener part 112 is provided with parallel grooves 148 and a finger stop 150 which enhance gripping when releasing the fastener. The male fastener part 112 is also provided with a pair of parallel flanges 152, 154, seen best in FIG. 11.

Figure 14:
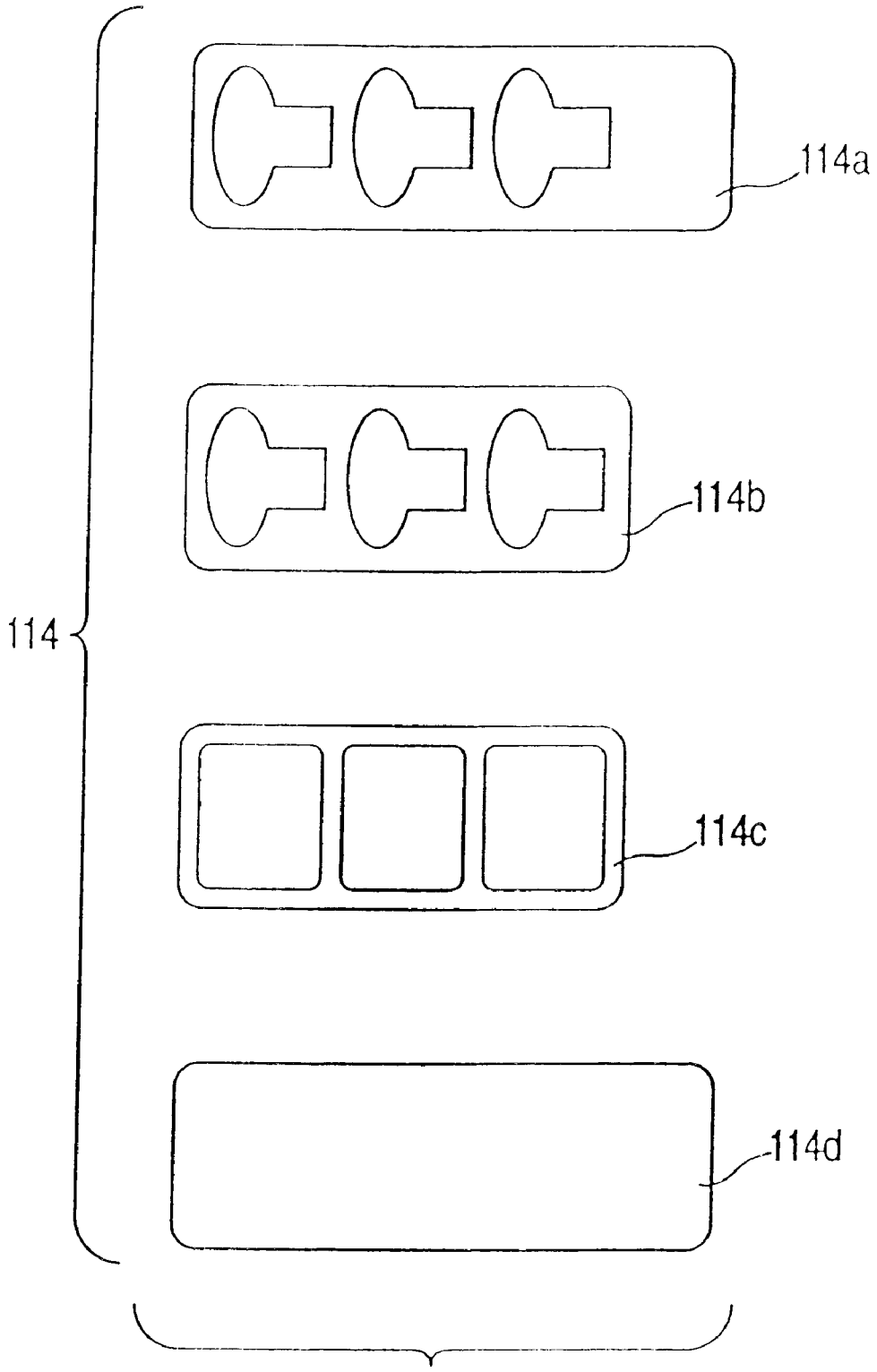
FIG. 14 is an exploded view of the component parts of a female fastener part according to a preferred embodiment.

Turning now to FIG. 14, the female fastener part 114 is preferably formed as a laminate structure which includes two outer layers 114*a*, 114*d* and two inner layers 114*b*, 114*c*. The outer layers 114*a*, 114*d* are made of a soft fabric material and the inner layers 114*b*, 114*c* are made of soft plastic. One of the plastic layers 114*b* has the openings as described and the other plastic layer 114*c* has thick portions which surround the openings in the other plastic layer to create a space for receiving the male fastener part. As shown in FIG. 14, the plastic "spacer layer" 114*c* has four rectilinear through bores.

Figure 15:
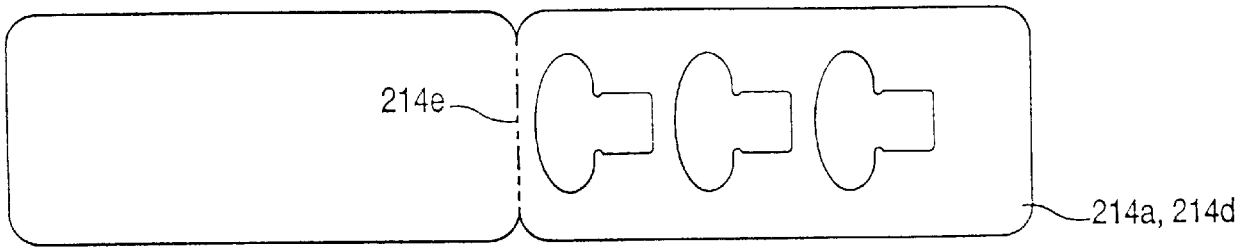
FIG. 15 is a plan view of the preferred outer laminate layers.
Figure 18:
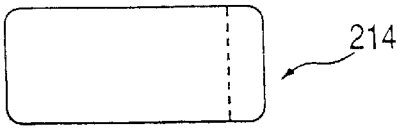
FIG. 18 is a plan view of the non-engaging side of the preferred female fastener part.
Figure 19:
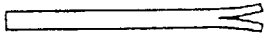
FIG. 19 is a side elevation view of the preferred female fastener part.
Figure 20:
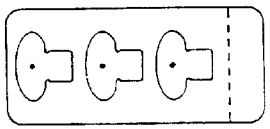
FIG. 20 is a plan view of the engaging side of the preferred female fastener part.
Figure 16:
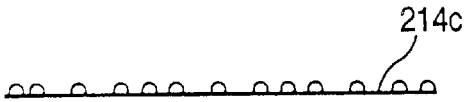
FIG. 16 is a side elevation view of a preferred spacer layer.
Figure 17:
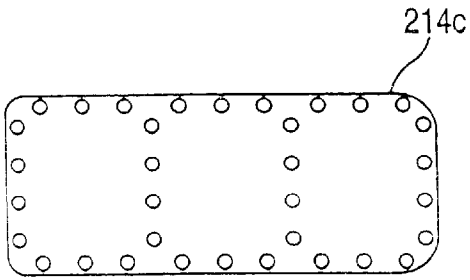
FIG. 17 is a plan view of the preferred spacer layer.

As shown in FIG. 15, the outer layers (114*a*, 114*d* in FIG. 14) are preferable formed as a single fabric layer 214*a*, 214*d* folded at fold line 214*e*. As shown in FIGS. 16 and 17, the plastic spacer 214*c* (114*c* in FIG. 14) is made by embossing a plastic sheet with raised bumps which surround the openings in the layer 114*b* in FIG. 14. The assembled female member 214 is shown in FIGS. 18–20.

There have been described and illustrated herein several embodiments of a fastener for clothing, in particular a brassier.

While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. An adjustable fastener for an article of clothing, said fastener comprising:

a) a male part having a base, a riser extending from said base, and a flange extending from the riser, said flange having a nub extending from its surface;

b) a female part having a plurality of spaced apart openings, each opening having a broad portion and a narrow portion, wherein said narrow portion of each opening is substantially rectilinear in shape, and said riser is substantially rectilinear in section and dimensioned to fit snugly in said narrow portion of each opening.

2. An adjustable fastener as claimed in claim 1, wherein said female part comprises a multi-ply laminate.

3. An adjustable fastener as claimed in claim 1, wherein:

said broad portion is substantially circular in shape, and said flange is substantially circular.

4. An adjustable fastener as claimed in claim 3, wherein:

said female part is made from a laminate of four layers, two outer layers of which are soft fabric and two inner layers of which are flexible plastic.

5. An adjustable fastener as claimed in claim 4, wherein:

one of said inner layers is an embossed sheet of plastic.

6. An adjustable fastener as claimed in claim 5, wherein:

said male part has a plurality of parallel groove a side thereof opposite said riser and said flange.

7. An adjustable fastener as claimed in claim 3, wherein:

said nub is centrally located, and said narrow portion of each opening has means for receipt of said nub.

8. An adjustable fastener as claimed in claim 7, wherein:

said male and female parts each have a pair of substantially parallel flanges extending from an end thereof.

9. An adjustable fastener as claimed in claim 8, wherein:

at least one of said substantially parallel flanges has a live hinge.

10. An adjustable fastener as claimed in claim 9, wherein:

each of said plurality of spaced apart openings is separated from an adjacent one of said plurality of openings by a flexible rib.

11. An adjustable fastener as claimed in claim 10, wherein:

said male part has a plurality of parallel groves on a side thereof opposite said riser and said flange.

12. An adjustable fastener for an article of clothing, said fastener comprising:

a) a male part having a base, a riser extending from said base, and a flange extending from the riser;

b) a female part having a plurality of spaced apart openings, each opening having a broad portion and a narrow portion, wherein said flange has a centrally located nub extending from its surface, and said narrow portion of each opening has a nub-receiving well.

13. An adjustable fastener as claimed in claim 12, wherein:

said broad portion of each opening is substantially circular in shape, and said flange is substantially circular.

14. An adjustable fastener as claimed in claim 13, wherein:

said narrow portion of each opening is substantially rectilinear in shape, and said riser is substantially rectilinear in section and dimensioned to fit snugly in said narrow portion of each opening.

15. An adjustable fastener as claimed in claim 14, wherein:

said male and female parts each have a pair of substantially parallel flanges extending from an end thereof.

16. An adjustable fastener as claimed in claim 15, wherein:

at least one of said substantially parallel flanges has a live hinge.

17. An adjustable fastener as claimed in claim 16, wherein:

each of said plurality of spaced apart openings is separated from an adjacent one of said plurality of openings by a flexible rib.

18. An adjustable fastener as claimed in claim 17, wherein:

said male part has a plurality of parallel groves on a side thereof opposite said riser and said flange.

19. An adjustable fastener for an article of clothing, said fastener comprising:

a) a male part having a base, a riser extending from said base, and a flange extending from the riser, said flange having a nub extending from its surface;

b) a female part having a plurality of spaced apart openings, each opening having a broad portion and a narrow portion, wherein said narrow portion of each opening is substantially rectilinear in shape, said broad portion of each opening is substantially circular in shape, said flange is substantially circular, and said female part is made from a laminate of four layers, two outer layers of which are soft fabric and two inner layers of which are flexible plastic.

20. An adjustable fastener as claimed in claim 19, wherein:

one of said inner layers is an embossed sheet of plastic.

21. An adjustable fastener as claimed in claim 20, wherein:

said male part has a plurality of parallel grooves on a side thereof opposite said riser and said flange.

22. An adjustable fastener for an article of clothing, said fastener comprising:

a) a male part having a base, a riser extending from said base, and a flange extending from the riser said flange having a nub extending from its surface;

b) a female part having a plurality of spaced apart openings, each opening having a broad portion and a narrow portion, wherein said narrow portion of each opening is substantially rectilinear in shape, and has a nub-receiving well said riser is substantially rectilinear in section and dimensioned to fit snugly in said narrow portion of each opening, and wherein said male and female parts each have a pair of substantially parallel flanges extending from an end thereof.

23. An adjustable fastener as claimed in claim 22, wherein:

said broad portion of each opening is substantially circular in shape; and said flange is substantially circular.

24. An adjustable fastener as claimed in claim 22, wherein:

at least one of said substantially parallel flanges has a live hinge.

25. An adjustable fastener as claimed in claim 22, wherein:

each of said plurality of spaced apart openings is separated from an adjacent one of said plurality of openings by a flexible rib.

26. An adjustable fastener as claimed in claim 22, wherein:

said male part has a plurality of parallel grooves on a side thereof opposite said riser and said flange.

* * * * *